US008270866B2

(12) United States Patent
Nishikawa

(10) Patent No.: US 8,270,866 B2
(45) Date of Patent: Sep. 18, 2012

(54) COOLING DEVICE AND IMAGE FORMING APPARATUS USING THE SAME

(75) Inventor: Satoru Nishikawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 274 days.

(21) Appl. No.: 12/813,958

(22) Filed: Jun. 11, 2010

(65) Prior Publication Data

US 2011/0116826 A1 May 19, 2011

(30) Foreign Application Priority Data

Nov. 17, 2009 (JP) ..... 2009-261952

(51) Int. Cl.
*G03G 21/20* (2006.01)

(52) U.S. Cl. ..... 399/92

(58) Field of Classification Search ..... 399/91–93, 399/98

See application file for complete search history.

(56) References Cited

U.S. PATENT DOCUMENTS

| | | | | |
|---|---|---|---|---|
| 7,477,860 | B2 * | 1/2009 | Hanano | 399/92 |
| 7,835,660 | B2 * | 11/2010 | Suzuki | 399/92 |
| 2008/0050145 | A1 | 2/2008 | Hanano | |
| 2009/0116865 | A1 | 5/2009 | Hanano | |

FOREIGN PATENT DOCUMENTS

| | | |
|---|---|---|
| JP | A 11-015308 | 1/1999 |
| JP | A 11-202738 | 7/1999 |
| JP | A 2003-223092 | 8/2003 |
| JP | A 2008-077077 | 4/2008 |

* cited by examiner

*Primary Examiner* — Hoan Tran
(74) *Attorney, Agent, or Firm* — Oliff & Berridge, PLC

(57) ABSTRACT

A cooling device having a cooling unit including an air suction port that is disposed at a front surface side of a main body of the cooling device to suck air, and an air exhaust port that is disposed at a rear surface side of the main body of the cooling device to exhaust air, in which the cooling unit transfers heat from a cooling target to air sucked from the air suction port to cool the cooling target, and discharges the heat-transferred air from the air exhaust port.

20 Claims, 12 Drawing Sheets

COOLING DEVICE AND IMAGE FORMING APPARATUS USING THE SAME

CROSS-REFERENCE TO RELATED APPLICATION

This application is based on and claims priority under 35 USC 119 from Japanese Patent Application No. 2009-261952 filed Nov. 17, 2009.

BACKGROUND

Technical Field

The present invention relates to a cooling device and an image forming apparatus using the cooling device.

SUMMARY

According to an aspect of the present invention, there is provided a cooling device including: a cooling unit including an air suction port that is disposed at a front surface side of a main body of the cooling device to suck air, and an air exhaust port that is disposed at a rear surface side of the main body of the cooing device to exhaust air, in which the cooling unit transfers heat from a cooling target to air sucked from the air suction port to cool the cooling target, and discharges the heat-transferred air from the air exhaust port; a first covering member that covers apart in a horizontal direction of an opening portion located at the front surface side of the main body, in which the air suction port is located, and a part in the horizontal direction of the air suction port; a second covering member that is adjacent to the first covering member in the horizontal direction and covers the other part of the opening portion and the other part of the air suction port; and a flow path member that is provided at a side of at least one of the first covering member or the second covering member, which faces the air suction port, and allows air to flow to the air suction port from an opening formed to be directed downwardly.

BRIEF DESCRIPTION OF THE DRAWINGS

An exemplary embodiment of the present invention will be described in detail based on the following figures, wherein.

DETAILED DESCRIPTION

Examples of a cooling device and an image forming apparatus according to an exemplary embodiment of the present invention will be described.

Figure 1:
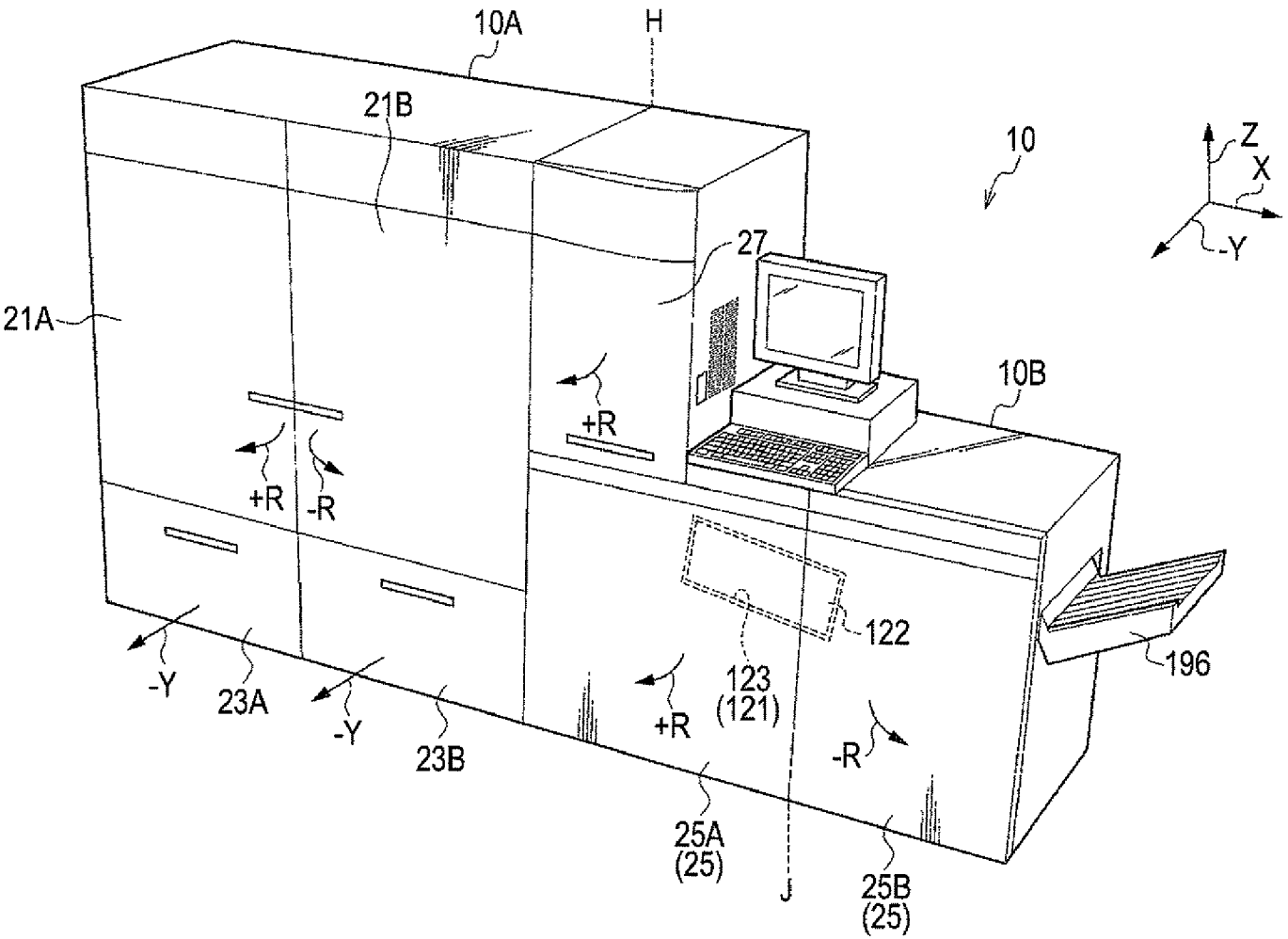
FIG. 1 is a diagram showing the outlook of an image forming apparatus according to an exemplary embodiment of the present invention.

FIG. 1 is a diagram showing an outlook of an image forming apparatus 10 according to the exemplary embodiment of the invention when the image forming apparatus 10 is viewed obliquely from a front upper right side. The image forming apparatus 10 forms a color image or a monochromatic image, and has a first processing unit 10A which is disposed at the left side with respect to a boundary H in front view, and a second processing unit 10B which is detachably secured to the first processing unit 10A and is disposed at the right side with respect to the boundary H. Each of the first processing unit lap, and the second processing unit 10B has a housing 11 (see FIG. 8) as an example of an apparatus main body configured by plural frame members.

The first processing unit 10A is provided with first doors 21A and 21B which are supported through hinge members (not shown) at the right and left ends thereof and can be opened/closed in a hinged-double-door opening mode, and second doors 23A and 23B which can be drawn out in a direction of an arrow −Y at the lower side of the first doors 21A and 21B. A direction of an arrow +R corresponds to a clockwise direction in plan view, and a direction of an arrow −R corresponds to a counterclockwise direction in plan view. The first doors 21A and 21B are opened independently of each other in the direction of the arrow +R (to the left side) and the direction of the arrow −R (to the right side), respectively.

The second processing unit 10B is supported at the right and left ends thereof through hinge members (not shown), and provided with a third door 25 which can be opened/closed in a hinged-double-door opening mode with a boundary J as a reference (mating position), and a fourth door 27 which is provided at the upper side of the third door 25 so as to be openable in the direction of the arrow +R. Here, the third door 25 has a left door 25A as an example of a first covering member which is opened in the direction of the +R arrow (to the left side), and a right door 25B as an example of a second covering member which is opened in the direction of the −R arrow (to the right side). The left door 25A covers a part in the horizontal direction of an opening portion 11A (see FIG. 8) at the front surface side of the housing 11, and also covers a part in the horizontal direction of an air suction port 123 described later. The right door 25B is adjacent to the left door 25A in the horizontal direction and covers the other part of the opening portion 11A and the other part of the air suction port 123. The left door 25A and the right door 25B are opened independently of each other. The boundary J is disposed so as to divide the air suction port 123 to the right and left sides in front view of the image forming apparatus.

Figure 5:
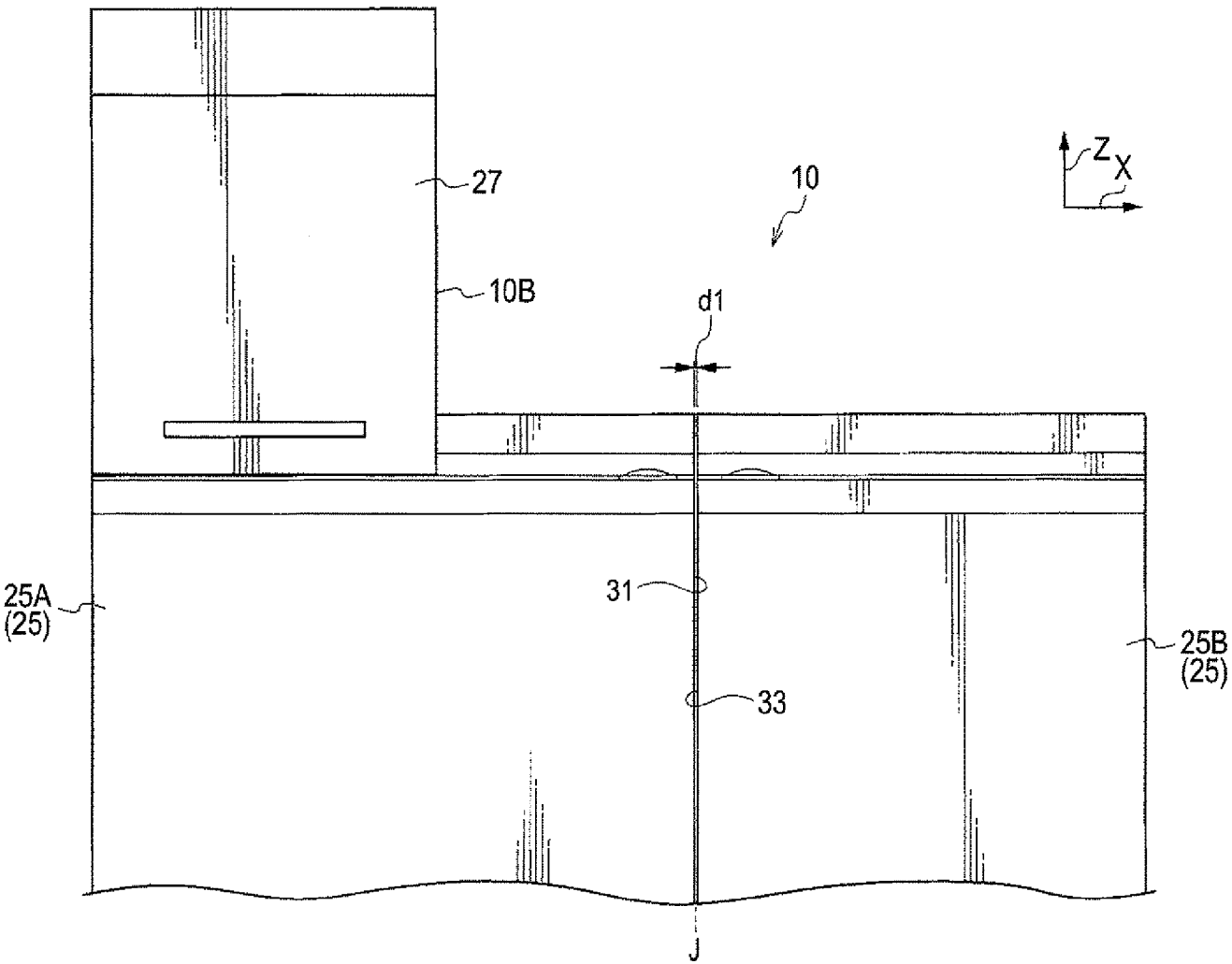
FIG. 5 is a front view of a second processing unit according to the exemplary embodiment of the present invention.

As shown in FIG. 5, the third door 25 is disposed so that a gap d1 is formed in a direction of an arrow X between a right side surface 31 of the left door 25A and a left side surface 33 of the right door 25B at the boundary J in front view when the left door 25A and the right door 25B are closed. Here, the gap in this exemplary embodiment means a gap whose size enables air flow therethrough. In FIG. 5, a discharge unit 196 described later is omitted from illustration.

Figure 2:
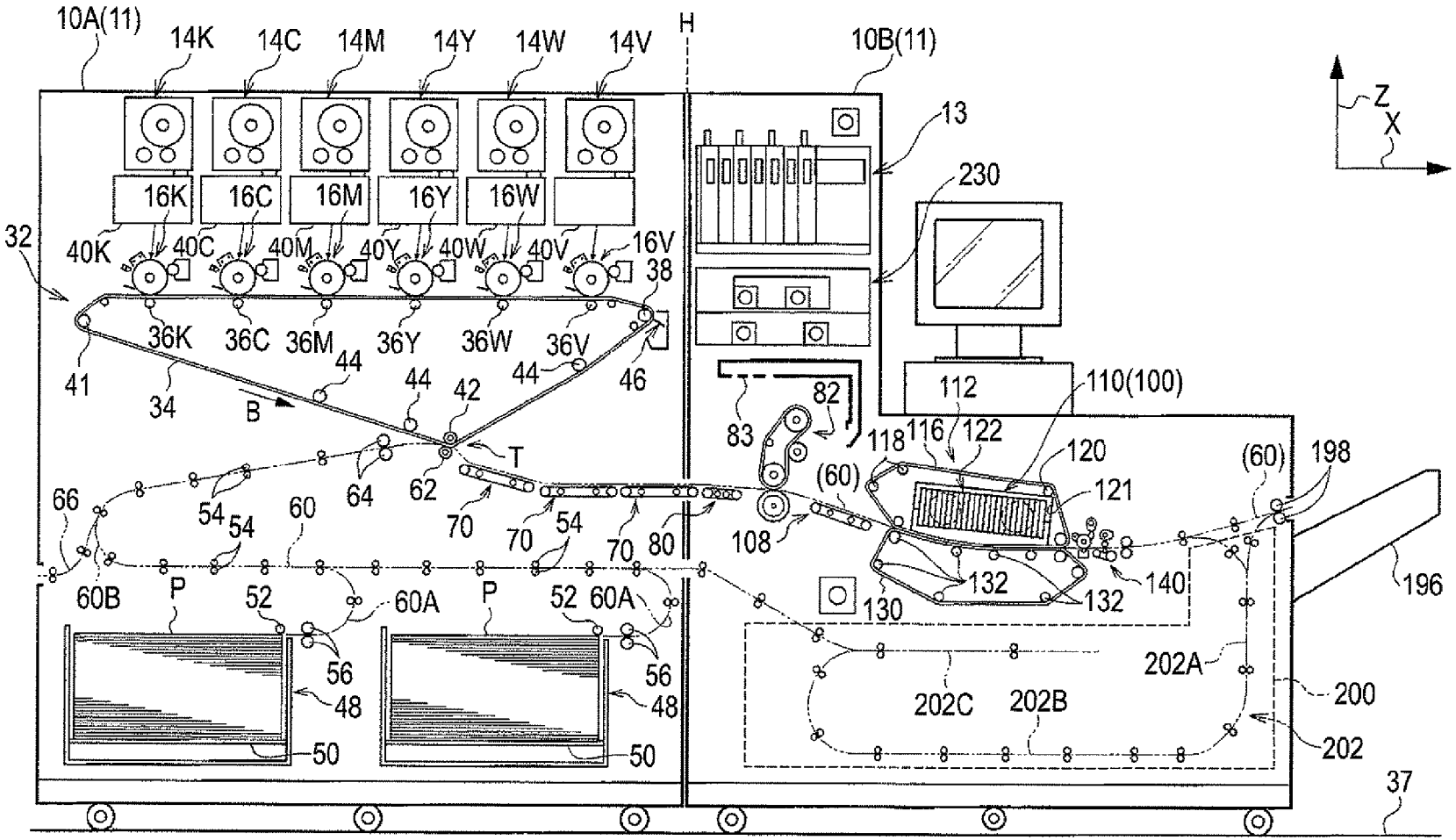
FIG. 2 is a diagram showing the overall configuration of the image forming apparatus according to the exemplary embodiment of the present invention.

FIG. 2 shows the overall internal configuration of the image forming apparatus 10. A controller 13 which contains an image signal processor for executing image processing on image data transmitted from a computer and controls the operation of each part of the image forming apparatus 10 is provided at the upper side in the vertical direction inside the second processing unit 10B. Furthermore, a power supply unit 230 is provided at the lower side of the controller 13. The power supply unit 230 converts AC current taken from the external to DC current and supplies the DC current to each part of the image forming apparatus 10.

Furthermore, toner cartridges 14V, 14W, 14Y, 14M, 14C and 14K in which first specific color (V) toner, second specific color (W) toner, yellow (Y) toner, magenta (M) toner, cyan (C) toner and black (K) toner are accommodated respectively are arranged in the horizontal direction side by side at the upper side in the vertical direction inside the first processing unit 10A so as to be exchangeable by new ones. The first specific color and the second specific color are selected from specific colors (containing transparency) other than yellow, magenta, cyan and black. Furthermore, in the following description, when V, W, Y, M, C and K are discriminated from one another, any alphabet of V, W, Y, M, C and K is appended behind numerals, and when they are not discriminated from one another, V, W, Y, M, C and K are omitted.

Six image forming units 16 each of which is an image forming section corresponding to each color toner are provided below the toner cartridges 14 so as to be arranged in the horizontal direction in connection with the respective toner cartridges 14. An exposure unit 40 as an example of an image forming section is provided below each toner cartridge 14 every image forming unit 16. The exposure unit 40 takes from the controller 13 the image data which has been subjected to image processing, modulates a semiconductor laser (not shown) in accordance with color material gradation data and emits modulated exposure light L from the semiconductor laser. Specifically, the exposure unit 40 irradiates a surface of a photoconductor 18 (see FIG. 3) described later with the exposure light L corresponding to each color to form an electrostatic latent image on the photoconductor 18.

Figure 3:
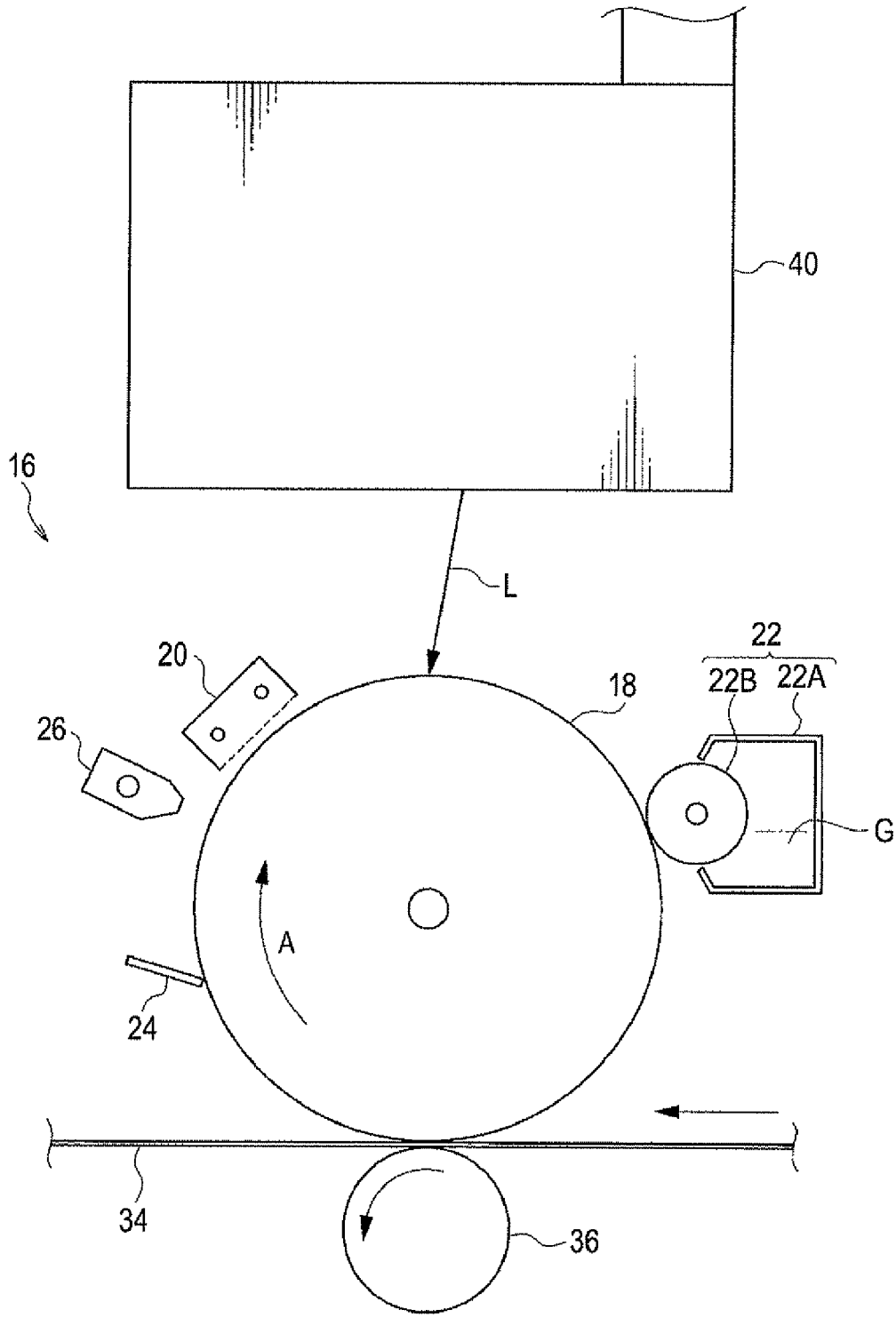
FIG. 3 is a diagram showing the construction of an image forming unit according to the exemplary embodiment of the present invention.

As shown in FIG. 3, the image forming unit 16 has the photoconductor 18 which is rotated in a direction of an arrow A (clockwise in FIG. 3). Around the photoconductor 18 are provided a corona discharge type (contactless charging type) scorotron charger 20 for charging the photoconductor 18, a developing device 22 for developing, with each color developer (toner), an electrostatic latent image formed on the photoconductor 18 by the exposure light L emitted from the exposure unit 40, a cleaning blade 24 for cleaning the surface of the post-transfer photoconductor 18, and an erase lamp 26 for irradiating the surface of the post-transfer photoconductor 18 with light to perform static elimination. The scorotron charger 20, the developing device 22, the cleaning blade 24 and the erase lamp 26 are successively arranged from the upstream side to the downstream side in the rotational direction of the photoconductor 18 in this order so as to face the surface of the photoconductor 18.

The developing device 22 is disposed at a side (the right side on the paper surface in this exemplary embodiment) of the image forming unit 16, and it contains a developer accommodating member 22A filled with developer G containing toner, and a developing roll 22B for moving the toner filled in the developer accommodating member 22A to the surface of the photoconductor 18. The developer accommodating member 22A is connected to the toner cartridge 14 (see FIG. 2) through a toner supply path (not shown), and supplied with toner from the toner cartridge 14.

As shown in FIG. 2, a transfer unit 32 is provided at the lower side of each image forming unit 16. The transfer unit 32 has an endless intermediate transfer belt 34 which is in contact with each photoconductor 18, and six primary transfer rolls 36 as primary transfer members which are disposed inside the intermediate transfer belt 34 and transfer toner images formed on the respective photoconductors 18 to the intermediate transfer belt 34 while multiplexing the toner images. The intermediate transfer belt 34 is wound around a driving roll 38 driven by a motor (not shown), a tension applying roll 41 for adjusting the tension of the intermediate transfer belt 34, a support roll 42 disposed so as to face a secondary transfer roll 62 described later and plural support rolls 44. The intermediate transfer belt 34 is circularly moved by the driving roll 38 in a direction of an arrow B (counterclockwise direction) of FIG. 2.

Specifically, each primary transfer roll 36 is disposed to face the photoconductor 18 of the corresponding one of the image forming units 16 through the intermediate transfer belt 34. A transfer bias voltage having the opposite polarity to the toner polarity is applied to the primary transfer roll 36 by a power supply unit (not shown). According to this configuration, the toner image formed on the photoconductor 18 is transferred to the intermediate transfer belt 34. Furthermore, a cleaning belt 46 having a tip portion which is brought into contact with the intermediate transfer belt 34 is provided at the opposite side to the driving roll 38 with respect to the intermediate transfer belt 34 so that the intermediate transfer belt 34 is sandwiched between the cleaning belt 46 and the driving roll 38. The cleaning blade 46 serves to remove residual toner, paper powder, etc. on the circularly moved intermediate transfer belt 34.

Two large-size sheet supply cassettes 48 in which sheet members P as an example of a cooling target and a recording media are accommodated are provided side by side in the horizontal direction below the transfer unit 32 at the lower side of the first processing unit 10A, so that a stack of sheet members P can be accommodated. The two sheet supply cassettes 48 have the same configuration. Therefore, only one sheet supply cassette 48 will be described, and the description of the other sheet supply cassette 48 is omitted.

The sheet supply cassette 48 is allowed to be freely drawn by drawing the second doors 23A and 23B (see FIG. 1) from the first processing unit 10A to the front side, and when the sheet supply cassette 48 is drawn out from the first processing unit 10A, a bottom plat 50 on which the sheet members P provided in the sheet supply cassette 48 are stacked is downwardly moved in response to an instruction of a controller (not shown). When the bottom plate 50 is downwardly moved, a user is allowed to replenish sheet members P. When the sheet supply cassette 48 is secured to the first processing unit 10A, the bottom plate upwardly moves in response to an instruction of the controller. A feed-out roll 52 for feeding out a sheet member P from the sheet supply cassette 48 to a sheet transporting path 60 is provided above one end side of the sheet supply cassette 48, and the uppermost sheet member P mounted on the upwardly moving bottom plate 50 and the feed-out roll 52 come into contact with each other. Furthermore, a separation roll 56 for preventing superimposed feeding of sheet members P is provided at the downstream side of the sheet feed-out roll 52 with respect to the sheet member transporting direction (hereinafter referred to as "downstream side"), and plural transporting rolls 54 for transporting a sheet member P to the downstream side with respect to the sheet transporting direction are provided at the downstream side of the separation roll 56.

The sheet transporting path 60 provided at the upper side of the sheet supply cassette 48 returns a sheet member P fed out from the sheet supply cassette 48 to the opposite side (to the left side in FIG. 2) by a first returning unit 60A, and further returns to the opposite side (to the right side in FIG. 2) by a second returning unit 60B. The sheet transporting path 60 extends to a transfer position T sandwiched between the secondary transfer roll 62 and the support roll 42.

An aligner (not shown) for correcting the tilt of a sheet member P being fed is provided at a site sandwiched between the second returning unit 60B and the transfer position T, and a positioning roll 64 for matching the moving timing of the toner image on the intermediate transfer belt 34 with the transporting timing of the sheet member P is provided at a site sandwiched between the aligner and the transfer position T.

Furthermore, a transfer bias voltage having the opposite polarity to the toner polarity is applied to the secondary transfer roll 62 by the power supply unit (not shown). According to this configuration, the respective color toner images which are transferred and multiplexed (superimposed) with one another onto the intermediate transfer belt 34 are secondarily transferred onto a sheet member P fed along the sheet transporting path 60 by the secondary transfer roll 62. A preliminary path 66 extending from the side surface of the first processing unit 10A is provided so as to merge with the second returning unit 60B of the sheet transporting path 60, so that a sheet member P fed out from an external large-capacity integrating unit (not shown) which is disposed adjacently to the first processing unit 10A is passed through the preliminary path 66 and enters the sheet transporting path 60.

Plural transporting devices 70 for transporting a sheet member P having a toner image transferred thereto to the second processing unit 10B are provided at the downstream side of the transfer position T. The transporting devices 70 have plural belt members each of which is wound around a driving roll and a driven roll (not shown). The belt members are rotated by rotationally driving the driving rolls, thereby transporting the sheet member P to the downstream side.

The downstream side of the transporting devices 70 extends from the first processing unit 10A to the second processing unit 10B. The sheet member P which is fed out by the transporting devices 70 is received by a transporting device 80 provided to the second processing unit 10B, and transported to the further downstream side. A fixing unit 82 as an example of a fixing device is provided at the downstream side of the transporting device 80, and the toner image which is transferred onto the surface of the sheet member P is fixed to the surface of the sheet member P under heat and pressure by the fixing unit 82. A duct 83 for exhausting air is provided around the fixing unit 82 so as to surround the fixing unit 82.

The fixing unit 82 has a heating unit containing a fixing belt and plural heating rolls, and a pressuring unit containing a pressuring roll which is disposed so as to be in contact with the fixing belt under pressure. In the fixing unit 82, the sheet member P is pressurized and heated to fix the toner image onto the sheet member P.

As shown in FIG. 2, a transporting device 108 for transporting the sheet member P fed out from the fixing unit 82 to the downstream side is provided at the downstream side of the fixing unit 82, and a transporting unit 112 for transporting the sheet member P heated by the fixing unit 82 to the downstream side is provided at the downstream side of the transporting device 108. Furthermore, a decurl processing unit 140 for rectifying warp of the sheet member P is provided at the downstream side of the transporting unit 112.

The transporting unit 112 is provided with an endless heat receiving belt 116 which is disposed at the upper side of the sheet transporting path 60 and comes into contact with the sheet member P to absorb heat of the sheet member P. Furthermore, an endless press belt 130 which comes into contact with the sheet member P to press the sheet member P to the heat receiving belt 116 is provided at the lower side of the sheet transporting path 60. Plural support rolls 118 and a driving roll 120 for transmitting driving force to the heat receiving belt 116 are provided at the inside of the heat receiving belt 116, whereby the heat receiving belt 116 is supported to be circularly movable in the transporting direction of the sheet member P. Plural support rolls 132 which are urged to the heat receiving belt 116 by urging units (not shown) such as springs are provided at the inside of the press belt 130, whereby the press belt 130 is circularly movable by the plural support rolls 132.

Discharge rolls 198 are provided at the downstream side of the decurl processing unit 140 to discharge a sheet member P having an image formed on one surface thereof to the discharging unit 196. The discharging unit 196 is secured to one side surface of the second processing unit 10B. Here, when images are formed on both the surfaces of a sheet member P, the sheet member P is transported to a reversing unit 200 provided at the downstream side of the decurl processing unit 140.

The reversing unit 200 is provided with a reversing path 202. The reversing path 202 has a branch path 202A branching from the sheet transporting path 60, a sheet transporting path 202B for transporting a sheet member P transported along the branch path 202A to the first processing unit 10A side, and a reversing path 202C for returning the sheet member P transported along the sheet transporting path 202B to the opposite direction so that the sheet member P is subjected to switchback transport to reverse the front and back surfaces of the sheet member P. According to this configuration, the sheet member P which is subjected to switchback transport along the reversing path 2020 is transported to the first processing unit 10A, and fed into the sheet transporting path 60 provided at the upper side of the sheet supply cassette 48, whereby the sheet member P is fed to the transfer position T again.

Next, a cooling device 100 will be described.

Figure 6A:
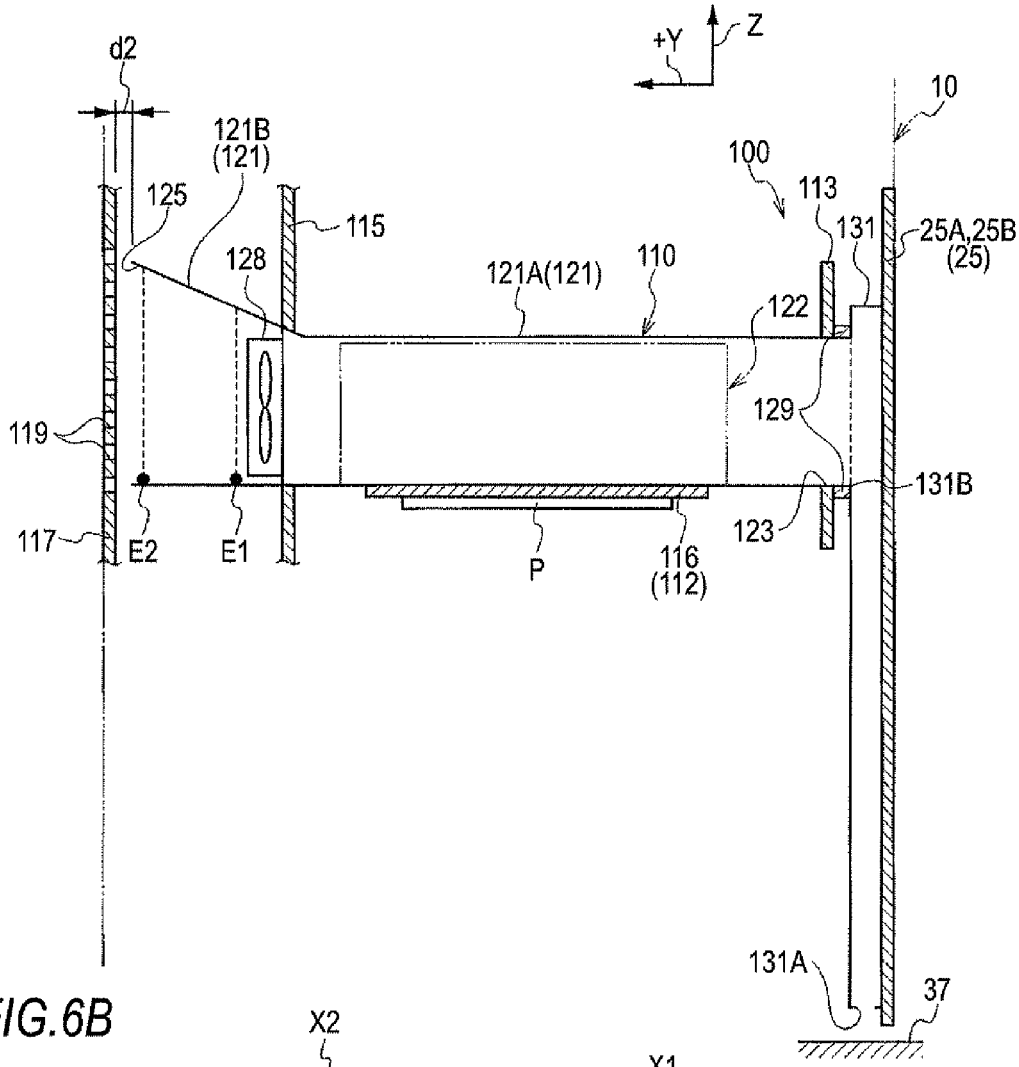
FIG. 6A is a cross-sectional view showing the construction of a cooling device according to the exemplary embodiment of the present invention.

As shown in FIG. 6A, the cooling device 100 contains a cooling unit 110 provided at a site of the transporting unit 112 in the sheet transporting path of the sheet member P, the third door 25 (the left door 25A and the right door 25B) constituting the front surface of the image forming apparatus 10 at a site of the transporting unit 112, and a door-side duct 131 as an example of a flow path member which is secured to the back surface side of the third door 25 and makes air flow to the cooling unit 110.

Figure 8:
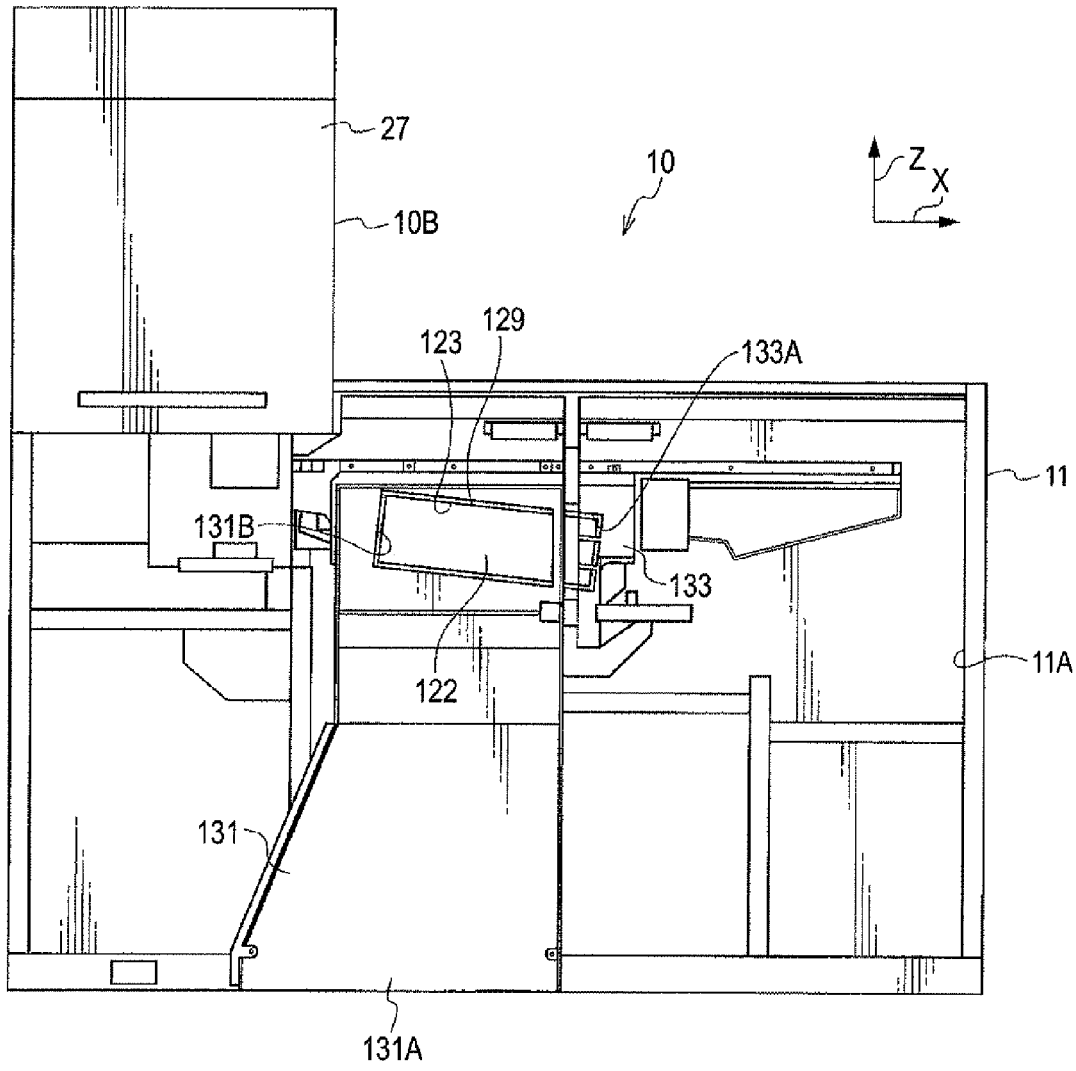
FIG. 8 is a diagram showing the door duct and the cooling unit according to the exemplary embodiment of the present invention.

The cooling unit 110 is provided inside the heat receiving belt 116 in the transporting unit 112, and contains an exhaust duct 121 as an example of an exhaust air flow path for making air flow from the front surface side of the image forming apparatus 10 (see FIG. 2) to the rear surface side, a heat sink 122 which is provided at some midpoint in the exhaust direction of the exhaust duct 121 and absorbs/transfers heat, and an exhaust fan 128 as an example of an exhaust unit for exhausting air heat-transferred by the heat sink 122 to the outside of the housing 11 (see FIG. 8).

The exhaust duct 121 has a cylindrical body extending from the air suction port 123 provided at the front surface side of the image forming apparatus 10 to an air exhaust port 125 provided to the rear surface side of the image forming apparatus 10, and it is designed so that the shape of the cross-section in a direction intersecting with the exhaust direction (a direction of a +Y arrow) is rectangular.

The exhaust duct 121 contains a first duct 121A and a second duct 121B which are connected to each other. The first duct 121A is disposed at the front surface side of the image forming apparatus 10 and configured so that the cross-section area thereof is constant in the exhaust direction, and the second duct 121B is disposed at the rear surface side of the image forming apparatus 10 and configured so that the cross-section thereof is tapered in the exhaust direction. The image forming apparatus 10 has a front surface panel 113 as an example of a facing member formed of plate material which is disposed so as to face the third door 25 at the inner front surface side thereof, a rear surface cover 117 as an example of a protection member which covers and protects the rear surface of the image forming apparatus 10, and a rear surface panel 115 as a plate material which is disposed at the upstream side of the rear surface cover 117 in the exhaust direction so as to face the rear surface cover 117.

The first duct 121A is provided so as to extend from the front surface panel 113 to the rear surface panel 115, and the heat sink 122 is installed in the first duct 121A. The second duct 121B is provided so as to extend from the rear surface panel 115 to the front side of the rear surface cover 117, and the exhaust fan 128 is secured at a site where the rear surface panel 115 is provided. A gap d2 is formed between the exhaust port 125 of the exhaust duct 121 and the rear surface cover 117, and plural exhaust holes 119 for exhausting air are formed at a site of the rear surface cover 117 so as to face the exhaust port 125.

Figure 6B:
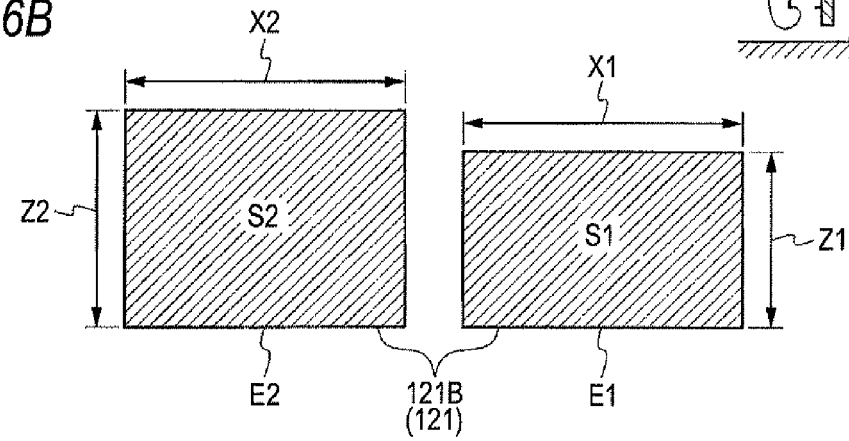
FIG. 6B is a schematic diagram showing cross-sectional areas of an exhaust duct according to the exemplary embodiment of the present invention.

As shown in FIGS. 6A and 6B, a position of the exhaust fan 128 side in the exhaust direction of the second duct 121B is represented by E1, and a position of the exhaust port 125 side in the exhaust direction of the second duct 121B is represented by E2. A width of the second duct 1218 in the direction of the arrow X (see FIG. 2) at the position E1 is represented by X1, a height of the second duct 121B in the direction of an arrow Z at the position E1 is represented by Z1, a width of the second duct 121B in the direction of the arrow X at the position E2 is represented by X2, and a height of the second duct 121B in the direction of the arrow Z at the position E2 is represented by Z2. Here, the cross-section of the tapered second duct 121B is enlarged in size toward the exhaust port 125 so as to satisfy X1=X2 and Z2>Z1, and a cross-sectional area S2 at the position E2 (=X2×Z2) is larger than a cross-sectional area S1 at the position E1 (=X1×Z1).

Figure 4:
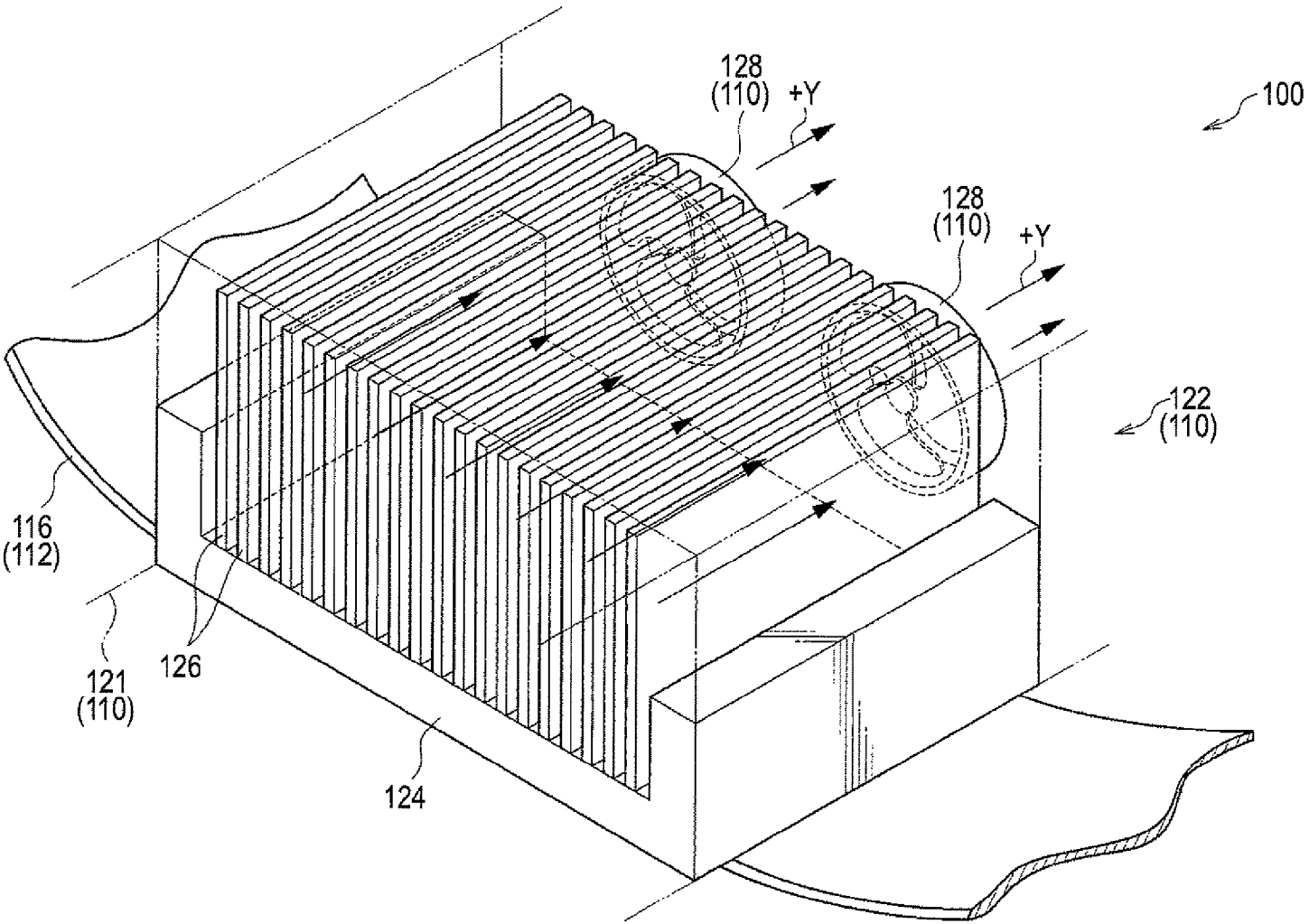
FIG. 4 is a perspective view showing a heat sink of a cooling unit according to the exemplary embodiment of the present invention.

As shown in FIG. 4, the heat sink 122 has a contact member 124 which is configured to be opened at the upper portion thereof and U-shaped in cross-section and presses the heat receiving belt 116 against the sheet member P under a state that a bottom surface thereof is brought into contact with the heat receiving belt 116, and plural heat radiating plates 126 which are projected from a recessed portion of the contact member 124 and transfer heat from the contact member 124 therethrough. For example, the contact member 124 and the heat radiating plates 126 may be made of aluminum.

Figure 7:
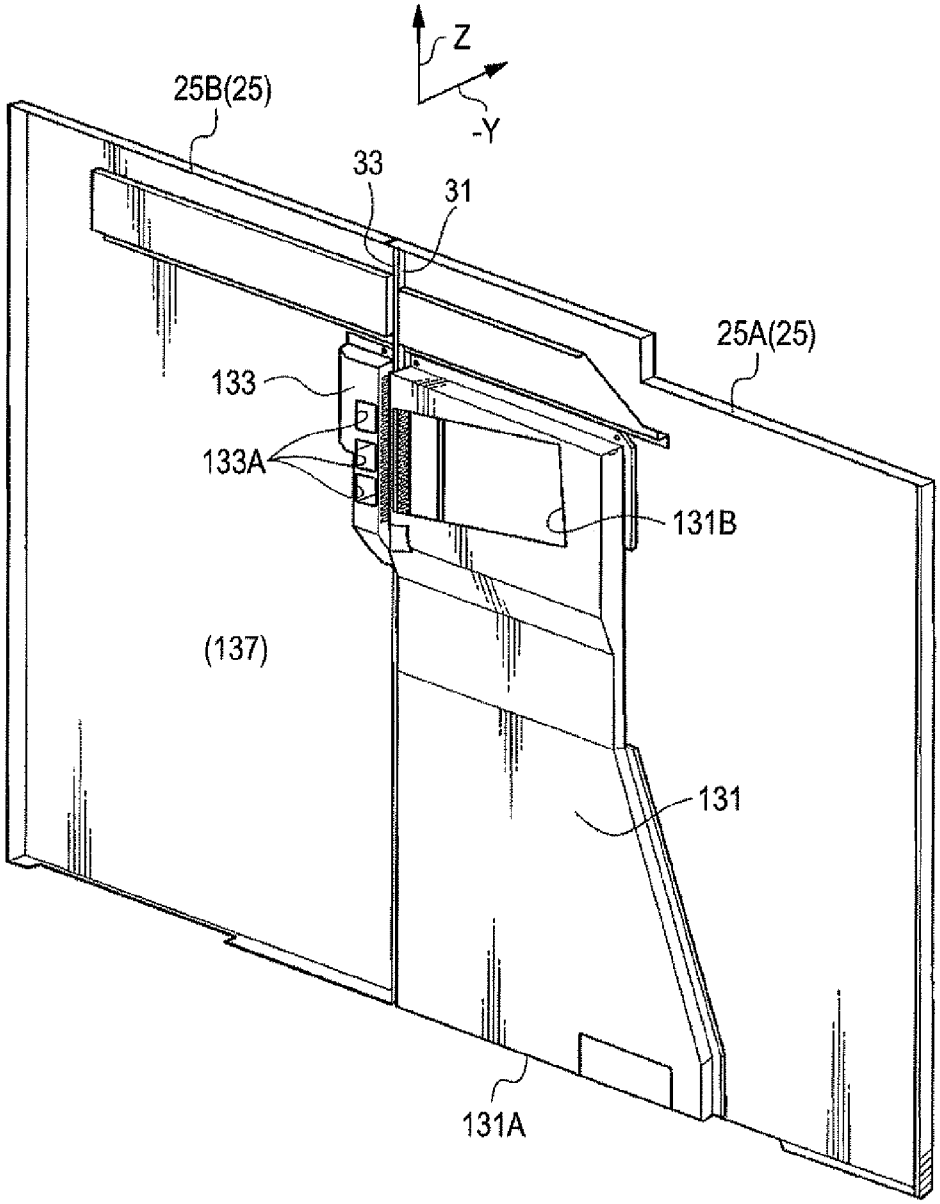
FIG. 7 is a perspective view showing a fixing state of a door duct according to the exemplary embodiment of the present invention.

As shown in FIGS. 6A, 7 and 8, the door-side duct 131 for making air flow from a lower side 37 to the air suction port 123 is provided at the back surface side of the left door 25A. The door-side duct 131 is a hollow structure which extends from a height position facing the air suction port 123 to a lower end portion at the right side surface 31 side of the left door 25A, and an introducing port 131A as an example of an opening is formed in the bottom wall of the door-side duct 131 so as to face the lower side 37. The door-side duct 131 is provided with a supply port 131B which is shaped and sized so as to be brought into contact with the air suction port 123 and integrated with the air suction port 123 at a position facing the air suction port 123.

As shown in FIGS. 7 and 8, an auxiliary duct 133 for making air flow from the inside of the apparatus main body of the image forming apparatus 10 (see FIG. 2) to the air suction port 123 (see FIG. 6A) is provided at the back surface side of the right door 2513. The auxiliary duct 133 is a hollow structure which covers a site facing the air suction port 123 at the left side surface 33 side of the right door 25B. Plural supply ports 133A are formed in the auxiliary duct 133 and arranged in juxtaposition with one another in the up-and-down direction so as to face the air suction port 123. An opening (not shown) for sucking air from the inside of the image forming apparatus 10 is formed in the side wall of the auxiliary duct 133. A site excluding the auxiliary duct 133 at the back surface side of the right door 25B is disposed so as to be away from the air suction port 123 to the front side (the direction of the −Y arrow), whereby a space portion 137 is formed between the front panel 113 (see FIG. 6A) and the right door 25B.

Figure 9:
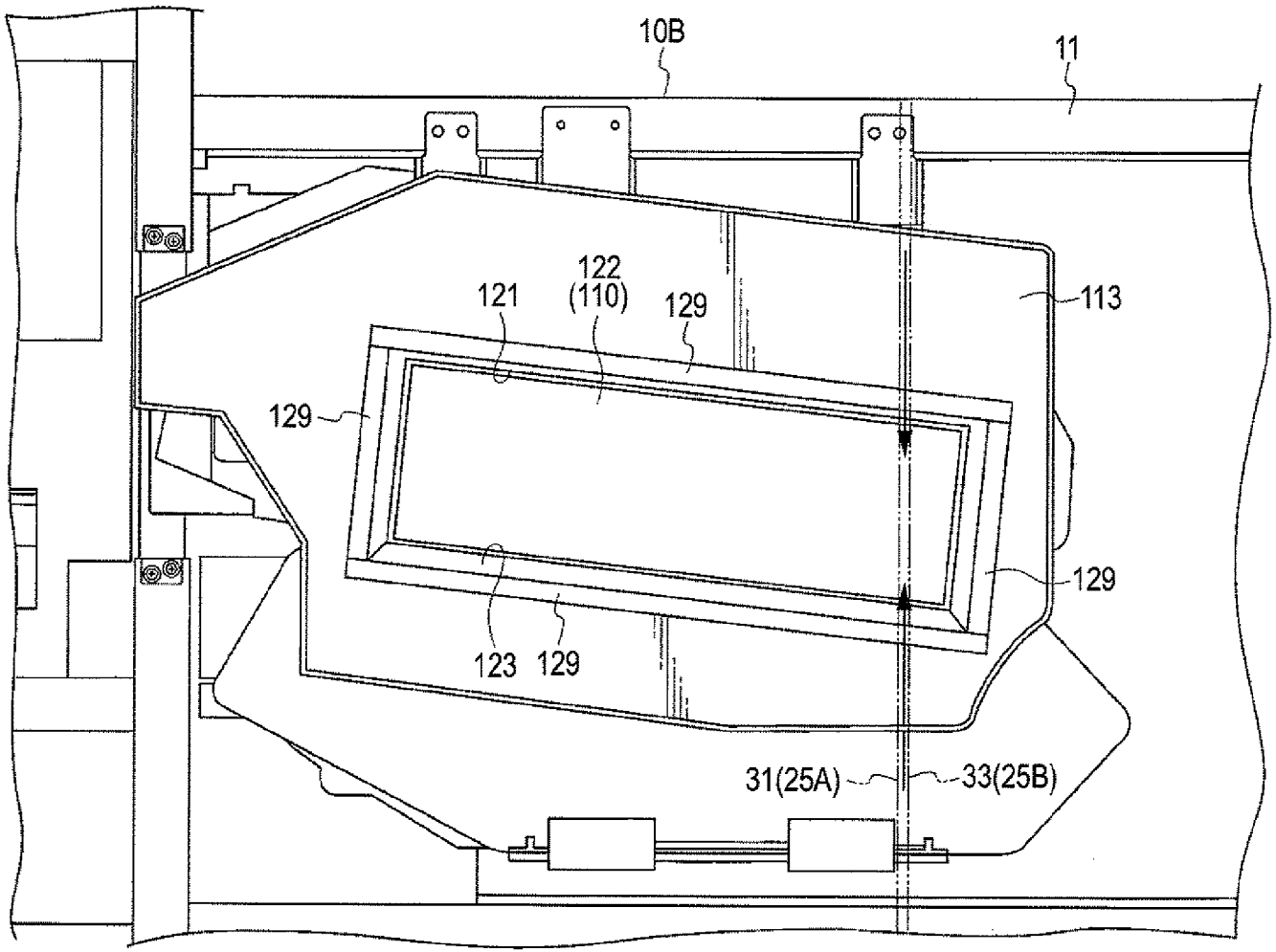
FIG. 9 is a diagram showing the surrounding configuration of the cooling unit according to the exemplary embodiment of the present invention and an air flow-in state.

As shown in FIG. 9, the front panel 113 spreads from the air suction port 123 to the outside, and a seal member 129 as an example of a sealing member surrounding the air suction port 123 in a rectangular shape is fixed to the peripheral edge portion of the air suction port 123 on the front panel 113. The seal member 129 is formed of a rectangular parallelepiped sponge as an example. Here, when the left door 25A and the right door 25B are closed, the door-side duct 131 comes into contact with the seal member 129 and also the seal member 129 is compressed as shown in FIG. 6A. Therefore, the door-side duct 131 and the exhaust duct 121 are kept to be hermetically sealed by the seal member 129. When the left door 25A and the right door 25B are closed, a gap is formed at a site where the right side surface 31 and the left side surface 33 face each other as shown in FIG. 9. Therefore, when air exhaust is executed in the cooling unit 110, the exhaust duct 121 is set to negative pressure and thus air flows from this gap to the air suction port 123. Here, the sealing of this exemplary embodiment contains a state under which air flows to the extent that cooling of the cooling unit 110 is not affected.

Figure 10:
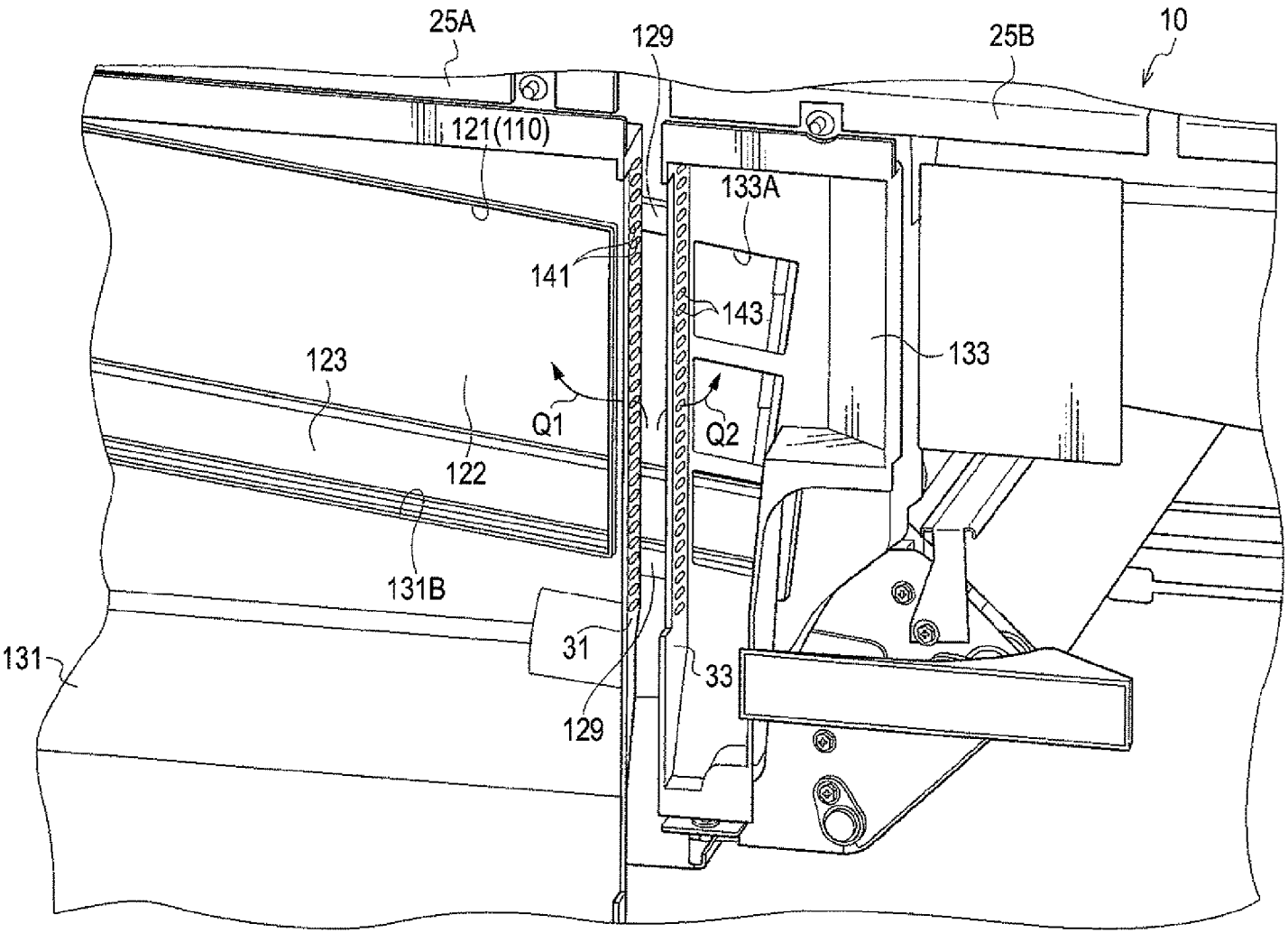
FIG. 10 is an enlarged view of the door duct at a boundary portion of a door according to the exemplary embodiment of the present invention.

As shown in FIG. 10, plural hole portions 141 and 143 for air suction are formed in the up-and-down direction in the right side surface 31 of the left door 25A (the door-side duct 131) and the left side surface 33 of the right door 25B (the auxiliary duct 133). The plural hole portions 141 and 143 are formed so as to be positionally matched with the air suction port 123 in the height direction. Here, when air is exhausted through the exhaust duct 121, air existing in the gap between the left door 25A and the right door 25B flows from the hole portions 141 to the door-side duct 131 and also flows from the air suction port 123 to the exhaust duct 121 as indicated by an arrow Q1, or the air flows from the hole portions 143 to the auxiliary duct 133 and also flows from the air suction port 123 to the exhaust duct 121 as indicated by an arrow Q2.

Figure 11:
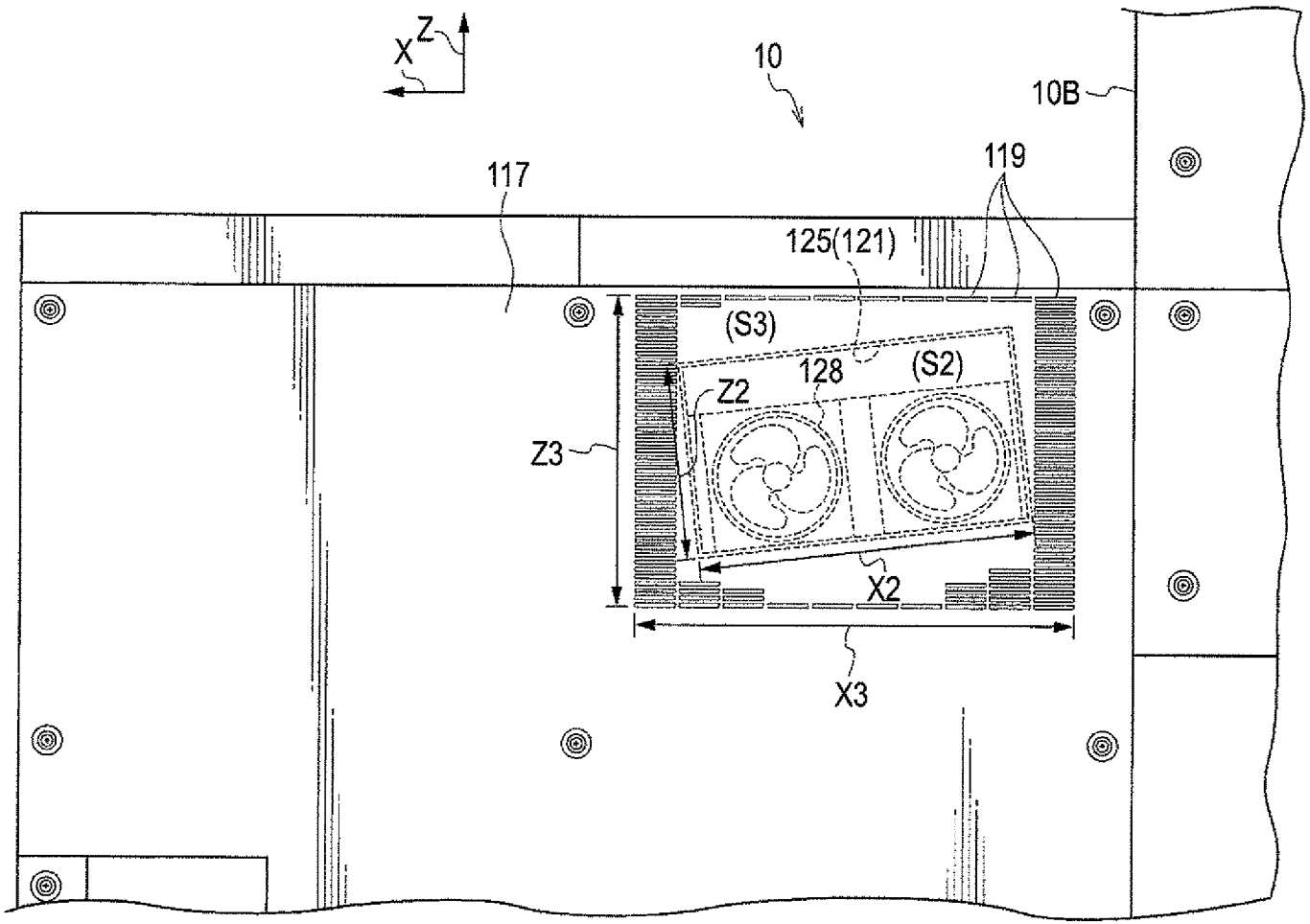
FIG. 11 is a diagram showing the construction of the second processing unit of the image forming apparatus according to the exemplary embodiment of the present invention viewed from a rear face side.

As described above, the rear surface of the image forming apparatus 10 is covered with the rear surface cover 117, and the plural exhaust holes 119 for air exhaust are formed in the rear surface cover 117 as shown in FIG. 11. In FIG. 11, in order to clarify the exhaust port 125, illustration of the exhaust port 125 and the exhaust holes 119 around the exhaust port 125 is partially omitted. An area of the rear surface cover 117 at which the plural exhaust holes 119 are formed has a rectangular shape of X3 (>X2) in lateral length and Z3 (Z2) in longitudinal length, and thus an area S3 of this area is equal to X3×Z3. Furthermore, the exhaust port 125 of the exhaust duct 121 has a rectangular shape of X2 in lateral length and Z2 in longitudinal length as described with reference to FIGS. 6A and 6B, and the cross-sectional area (opening area) S2 in the direction intersecting with the exhaust direction is equal to X2×Z2. Here, X2<X3 and Z2<Z3 are satisfied, and therefore the area S3 of the area where the exhaust holes 119 are formed is larger than the cross-sectional area S2 of the exhaust port 125.

Next, an action of this exemplary embodiment will be described.

First, an image forming process of the image forming apparatus 10 will be described.

As shown in FIG. 1, when each unit of the image forming apparatus 10 is set to an actuation state, image data which are subjected to image processing by the controller 13 are converted to color material gradation data of respective colors, and then successively output to the exposure units 40. In each exposure unit 40, each exposure light L is emitted in accordance with the color material gradation data of each color, and each photoconductor 18 charged by the scorotron charger 20 (see FIG. 2) is irradiated and scanned with the exposure light L from the corresponding exposure unit 40, whereby an electrostatic latent image is formed on each photoconductor 18. The electrostatic latent images formed on the respective photoconductors 18 (see FIG. 2) are visualized as toner images (developer images) of respective colors of first specific color (V), second specific color (W), yellow (Y), magenta (M), cyan (C) and black (K) by the developing devices 22, thereby performing a developing operation.

Subsequently, the toner images of the respective colors which are successively formed on the photoconductors 18 of the respective image forming units 16V, 16W, 16Y, 16M, 16C and 16K are successively transferred and multiplexed onto the intermediate transfer belt 34 by the six primary transfer rolls 36V, 36W, 36Y, 36M, 36C and 36K. The toner images of the respective colors which have been transferred and multiplexed on the intermediate transfer belt 34 are secondarily transferred onto a sheet member P transported from the sheet supply cassette 48 by the secondary transfer roll 62. The sheet member P having the toner images transferred thereon is transported to the fixing unit 82 provided in the second processing unit 10B by the transporting device 70.

Subsequently, the respective color toner images on the sheet member P are heated and pressurized by the fixing unit 82, whereby the color toner images are fixed onto the sheet member P. Furthermore, the sheet member P having the toner images fixed thereto is passed through the cooling unit 110 while cooled, and then fed to the decurl processing unit 140, thereby rectifying warp occurring in the sheet member P. Thereafter, the warp-corrected sheet member P is discharged to the discharge unit 196 by the discharge roll 198.

On the other hand, when an image is formed on a non-image surface of a sheet member P on which no image is formed (i.e., in the case of a double-face printing), the sheet member P is fed out to the reversing unit 200 by a switching member (not shown). The sheet member P fed out to the reversing unit 200 is passed through the reversing path 202 while reversed, and then fed to the sheet transporting path 60 provided above the sheet supply cassette 48 to form toner images on the back surface of the sheet member P in the procedure described above.

Next, a cooling action of the cooling device 100 will be described.

Figure 12:
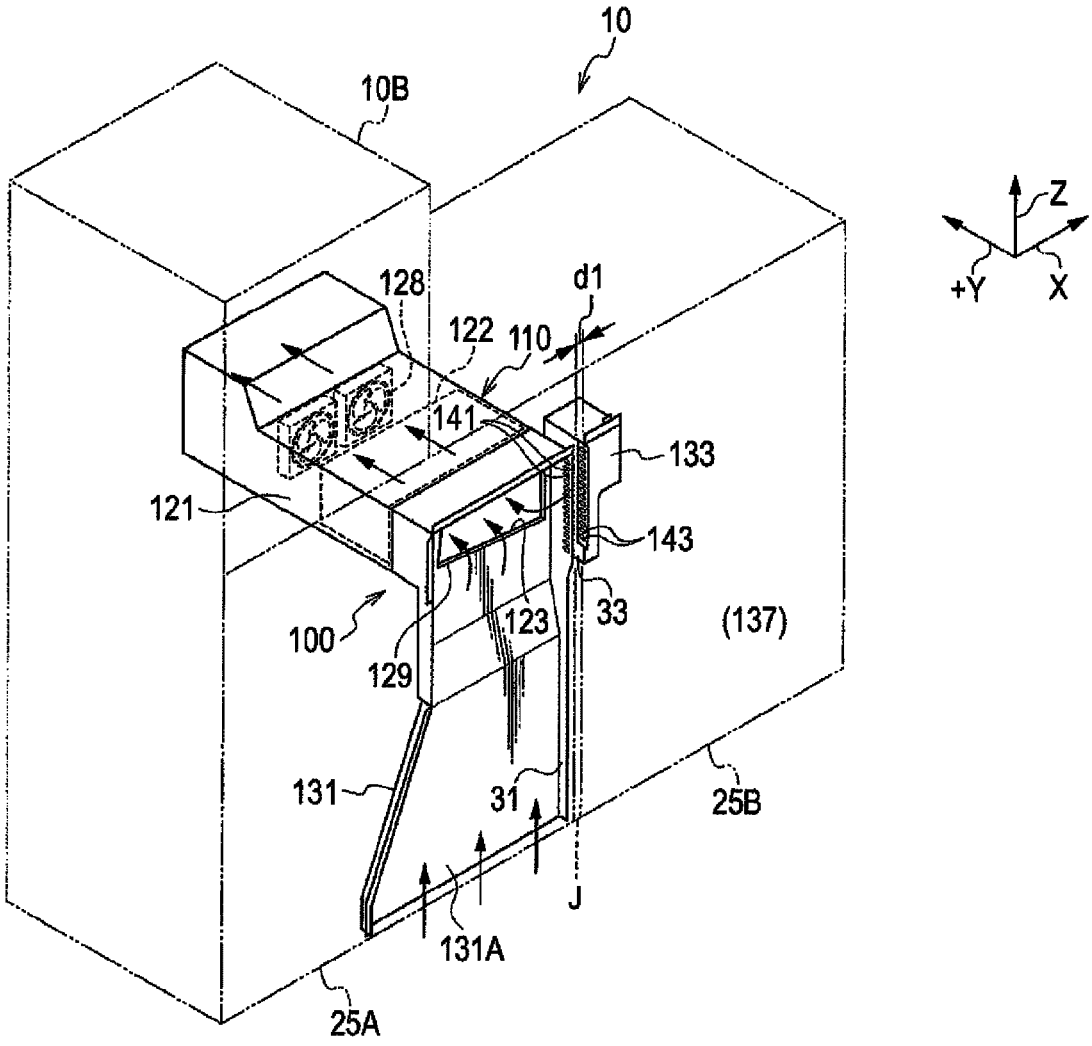
FIG. 12 is a diagram showing an air flowing state in the door duct and the cooling unit according to the exemplary embodiment of the present invention.

When the image forming apparatus 10 is actuated, the exhaust fan 128 of the cooling device 100 is driven by the controller 13 (see FIG. 1) as shown in FIG. 12. By driving the exhaust fan 128, the inside of the exhaust duct 121 is set to a negative pressure state, and the inside of the door-side duct 131 continuous with the exhaust duct 121 is set to a negative pressure state. Here, under the state that the left door 25A and the right door 25B are closed, air is introduced from the introducing port 131A into the door-side duct 131. The introduced air flows upwardly in the door-side duct 131, and further is sucked from the air suction port 123 into the exhaust duct 121. Since air is introduced from the introducing port 131A at the bottom surface side of the image forming apparatus 10 as described above, hole portions for introducing air are not required to be formed in the left door 25A and the right door 25B. Accordingly, the image forming apparatus 10 is not defaced when viewed from the front side thereof. Air suction is also performed from the auxiliary duct 133 to the air suction port 123.

Subsequently, as shown in FIG. 4, the contact member 124 of the heat sink 122 comes into contact with the heat receiving belt 116 over the plane thereof in the exhaust duct 121, and heat which is absorbed from the sheet member P by the heat receiving belt 116 is transferred from the heat radiating plate 126 to air flowing in the exhaust duct 121, whereby the heat of the sheet member P is deprived and thus cooled by the air. As shown in FIGS. 6A and 12, the air in the exhaust duct 121 which is set to a high-temperature state by the heat radiation from the heat radiating plate 126 is exhausted from the air exhaust port 125 and also from the exhaust holes 119 of the rear surface cover 117 by the exhaust fan 128.

Here, in the cooling device 100, the door-side duct 131 is provided to the left door 25A located at the upstream side in the transporting direction of the sheet member P (at the side nearer to the fixing unit 82 (see FIG. 2)), and thus outdoor air flows to the upstream side under a higher temperature state than the downstream side in the transporting direction. Accordingly, as compared with a case where the door-side duct 131 is provided at the downstream side in the transporting direction of the sheet member P, the efficiency of cooling the sheet member P and the inside of the image forming apparatus 10 is more greatly increased. Furthermore, the boundary J is provided at the front surface side of the air suction port 123, and the left door 25A and the right door 25B are opened in a hinged-double-door opening style, so that the maintenance and check work for the door-side duct 131, the exhaust duct 121 and the heat sink 122 can be more easily performed.

Most of the right door 25B located at the downstream side in the transporting direction of the sheet member P is located to be away from the air suction port 123 to the front surface side, thereby forming the space portion 137. Therefore, as compared with a case where the air suction port 123 and the right door 25B are in close contact with each other, the pressure loss caused by flow of sucked air can be reduced. Accordingly, the amount of air flowing to the air suction port 123 increases. Furthermore, the left door 25A and the right door 25B are disposed so as to be spaced from each other through the gap d1 at the boundary J, and also the hole portions 141 and 143 are formed in the right side surface 31 of the left door 25A and the left side surface 33 of the right door 25B. Accordingly, outdoor air flows from the gap d1 through the hole portions 141 and 143 into the air suction port 123, and added to air flowing from the introducing port 131A, so that the amount of air flowing to the air suction port 123 increases.

Furthermore, the hole portions 141 and 143 are formed in conformity with the height of the air suction port 123, and thus the range in which air flows is limited to a smaller one as compared with a case where the hole portions 141 and 143 are formed overall in the up-and-down direction of the right side surface 31 and the left side surface 33. Accordingly, air whose temperature increases in the image forming apparatus 10 (air flowing from the fixing unit 82) is suppressed from flowing through the hole portions 141 and 143 into the image forming apparatus 10 again.

Furthermore, the seal member 129 surrounds the periphery of the air suction port 123, and also the front panel 113 (see FIG. 9) spreading from the air suction port 123 to the outside is provided. Therefore, when high-temperature air in the image forming apparatus 10 (air flowing from the fixing unit 82) flows from the contact portion (containing the air suction port 123) between the door-side duct 131 and the exhaust duct 121 into the exhaust duct 121, the air meets with resistance. Accordingly, the high-temperature air is suppressed from flowing into the exhaust duct 121.

As shown in FIGS. 6A and 6B, the cross-sectional area S2 of the cross-section of the flow path at the downstream side in the exhaust direction is larger than the cross-sectional area S1 of the cross-section of the flow path at the upstream side in the exhaust direction in the second duct 121B of the exhaust duct 121. Furthermore, the exhaust port 125 and the rear surface cover 117 are disposed so as to be spaced from each other. Still furthermore, as shown in FIG. 11, the area S3 of the area of the rear surface cover 117 in which the exhaust holes 119 are formed is larger than the cross-sectional area S2 of the exhaust port 125. By anyone of these configurations, the pressure loss of exhaust at the air exhaust port 125 is reduced, and thus the exhaust flow amount at the air exhaust port 125 increases.

The door-side duct 131 may be provided to not only the left door 25A located at the upstream side in the transporting direction of the sheet member P, but also the right door 25B. Furthermore, the seal member 129 is not limited to sponge, but any material such as rubber may be used insofar as it has an elastic member which can intercept air. A covering member which can be mounted in the housing 11 or detached from the housing 11 may be used in place of the third door 25. Furthermore, a part of the exhaust duct 121 may be configured by the heat sink 122.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The exemplary embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cooling device comprising:

a cooling unit including an air suction port that is disposed at a front surface side of a main body of the cooling device to suck air, and an air exhaust port that is disposed at a rear surface side of the main body of the cooling device to exhaust air, in which the cooling unit transfers heat from a cooling target to air sucked from the air suction port to cool the cooling target, and discharges the heat-transferred air from the air exhaust port;

a first covering member that covers a part in a horizontal direction of an opening portion located at the front surface side of the main body, in which the air suction port is located, and a part in the horizontal direction of the air suction port;

a second covering member that is adjacent to the first covering member in the horizontal direction and covers the other part of the opening portion and the other part of the air suction port; and a flow path member that is provided at a side of at least one of the first covering member or the second covering member, which faces the air suction port, and allows air to flow to the air suction port from an opening formed to be directed downwardly.

2. The cooling device according to claim 1, wherein the cooling target is transported from the first covering member side to the second covering member side and cooled, and the flow path member is provided to at least the first covering member.

3. The cooling device according to claim 2, wherein the second covering member is disposed so as to be away from the air suction port to the front surface side.

4. The cooling device according to claim 1, wherein the first covering member and the second covering member have mating surfaces that are disposed with a gap therebetween.

5. The cooling device according to claim 4, wherein the flow path member has hole portions for air suction on a side surface thereof located at the mating surface side of the first covering member and the second covering member.

6. The cooling device according to claim 5, wherein the position of the hole portions in the vertical direction is set to be matched with the position of the air suction port in the vertical direction.

7. The cooling device according to claim 1, further comprising a sealing member provided around the air suction port for sealing the air suction port and the flow path member by contacting with the flow path member when the air suction port is covered with the first covering member and the second covering member.

8. The cooling device according to claim 7, further comprising a facing member that extends outside the sealing member around the air suction port, and faces the first covering member and the second covering member.

9. The cooling device according to claim 1, wherein the cooling unit has an exhaust flow path through which air flows from the air suction port to the air exhaust port, and an exhaust unit that exhausts air from the exhaust flow path, and wherein a cross-sectional area of the exhaust flow path at a downstream side in an exhaust direction of the exhaust unit is set to be larger than that at an upstream side in the exhaust direction.

10. The cooling device according to claim 1, further comprising a protection member that covers and protects the rear surface of the main body of the cooling device and has a plurality of exhaust holes formed to face the air exhaust port, and an area of the protection member where the plurality of exhaust holes are formed is set to be larger than an opening area of the air exhaust port.

11. The cooling device according to claim 10, wherein the air exhaust port and the protection member are disposed so as to be spaced from each other.

12. An image forming apparatus comprising:

a cooling device including: a cooling unit including an air suction port that is disposed at a front surface side of a main body of the cooling device to suck air, and an air exhaust port that is disposed at a rear surface side of the main body of the cooing device to exhaust air, in which the cooling unit transfers heat from a cooling target to air sucked from the air suction port to cool the cooling target, and discharges the heat-transferred air from the air exhaust port; a first covering member that covers a part in a horizontal direction of an opening portion located at the front surface side of the main body, in which the air suction port is located, and a part in the horizontal direction of the air suction port; a second covering member that is adjacent to the first covering member in the horizontal direction and covers the other part of the opening portion and the other part of the air suction port; and a flow path member that is provided at a side of at least one of the first covering member or the second covering member, which faces the air suction port, and allows air to flow to the air suction port from an opening formed to be directed downwardly; and a heating unit that is disposed at an upstream side of the cooling device in a transporting direction of a recording medium as the cooling target; and an image forming unit that is disposed at an upstream side of the heating unit in the transporting direction of the recording medium and forms an image on the recording medium with powder.

13. The image forming apparatus according to claim 12, wherein the cooling target is transported from the first covering member side to the second covering member side and cooled, and the flow path member is provided to at least the first covering member.

14. The image forming apparatus according to claim 13, wherein the second covering member is disposed so as to be away from the air suction port to the front surface side.

15. The image forming apparatus according to claim 12, wherein the first covering member and the second covering member have mating surfaces that are disposed with a gap therebetween.

16. The image forming apparatus according to claim 15, wherein the flow path member has hole portions for air suction on a side surface thereof located at the mating surface side of the first covering member and the second covering member.

17. The image forming apparatus according to claim 16, wherein the position of the hole portions in the vertical direction is set to be matched with the position of the air suction port in the vertical direction.

18. The image forming apparatus according to claim 12, further comprising a sealing member provided around the air suction port for sealing the air suction port and the flow path member by contacting with the flow path member when the air suction port is covered with the first covering member and the second covering member.

19. The image forming apparatus according to claim 18; further comprising a facing member that extends outside the sealing member around the air suction port, and faces the first covering member and the second covering member.

20. The image forming apparatus according to claim 12; wherein the cooling unit has an exhaust flow path through which air flows from the air suction port to the air exhaust port, and an exhaust unit that exhausts air from the exhaust flow path, and wherein a cross-sectional area of the exhaust flow path at a downstream side in an exhaust direction of the exhaust unit is set to be larger than that at an upstream side in the exhaust direction.

* * * * *